United States Patent [19]

Ailor

[11] 4,183,769

[45] Jan. 15, 1980

[54] METHODS AND APPARATUS FOR GLASS REMOVAL

[75] Inventor: James C. Ailor, Kokomo, Ind.

[73] Assignee: Cabot Corporation, Kokomo, Ind.

[21] Appl. No.: 832,220

[22] Filed: Sep. 12, 1977

[51] Int. Cl.[2] ..... B08B 7/00

[52] U.S. Cl. ..... 134/6; 134/9; 241/27; 241/235; 241/102

[58] Field of Search ..... 241/227, 235, 27, DIG. 38, 241/102; 134/6, 9

[56] References Cited

U.S. PATENT DOCUMENTS

| | | | |
|---|---|---|---|
| 2,114,580 | 4/1938 | Thompson | 241/227 X |
| 2,306,427 | 12/1942 | Christman et al. | 241/102 |

FOREIGN PATENT DOCUMENTS

| | | | |
|---|---|---|---|
| 81690 | 11/1894 | Fed. Rep. of Germany | 241/227 |

OTHER PUBLICATIONS

Penn General Supply Co. Catalogue 101, 101 Market St., Pittsburgh, Pa., p. 18 (copyright 1939).

*Primary Examiner*—Arthur D. Kellogg
*Attorney, Agent, or Firm*—Jack Schuman; Joseph J. Phillips

[57] ABSTRACT

A method and apparatus for removal of glass from metal surfaces, as for example, glass tubing from aspiration cast rods, is provided in which the glass coated metal is passed between a pair of spaced driven rolls, one being a resilient roll and the other a toothed metal roll, said rolls being adjustable to vary the spacing therebetween dependent upon the thickness of metal being cleaned, whereby the glass coating is broken into small fragments by the toothed roll.

7 Claims, 2 Drawing Figures

METHODS AND APPARATUS FOR GLASS REMOVAL

This invention relates to methods and apparatus for glass removal and particularly for removal of glass from metal surfaces such as aspiration cast rods and the like.

The removal of glass from metal surfaces such as from aspiration cast rods, e.g. weld rods or from glass lubricated extrusions is generally tedious and less than satisfactory. This can be reasonably effective where the surfaces are broad and flat, however, where the object is small in cross section, the breakage of the glass frequently is such that the pieces are not released and the glass is simply broken transversely along its length and remains attached to the metal.

I have invented an apparatus and method for removing glass from metal surfaces and the like which eliminates these problems. In my method the glass is broken into fine pieces and removed from the surfaces with no damage to the metal part.

Preferably I provide a pair of spaced apart rolls forming an adjustable pass line therebetween, one of said rolls being a resilient roll, the other of said rolls being circumferentially toothed to engage and break up the glass, means for adjusting the rolls apart and drive means rotating said rolls to move an article coated with glass therethrough. Preferably the resilient roll is a rubber roll. The toothed roll is preferably a plurality of side-by-side dresser wheels, such as are commonly used to dress grinding wheels, put together on a common shaft to form a roll. The rolls are mounted in a housing having means for spacing their axes apart at selected distances dependent upon the glass thickness and the metal thickness of the piece being cleaned. The rolls are preferably driven by an electric motor through a gear train. Preferably there are provided a plurality of successive such pairs of rolls through which the article being cleaned is passed.

Figure 1:
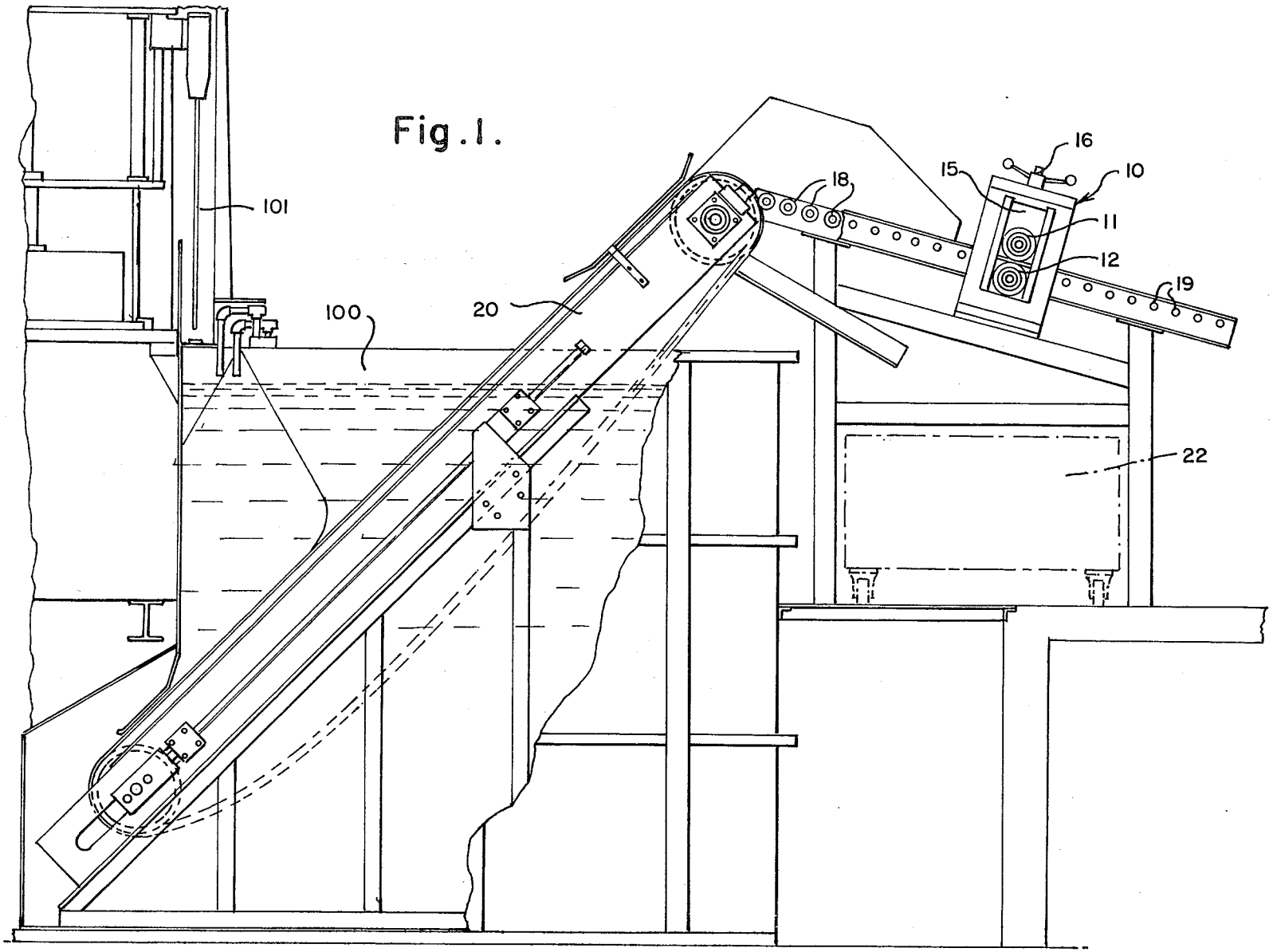
Figure 2:
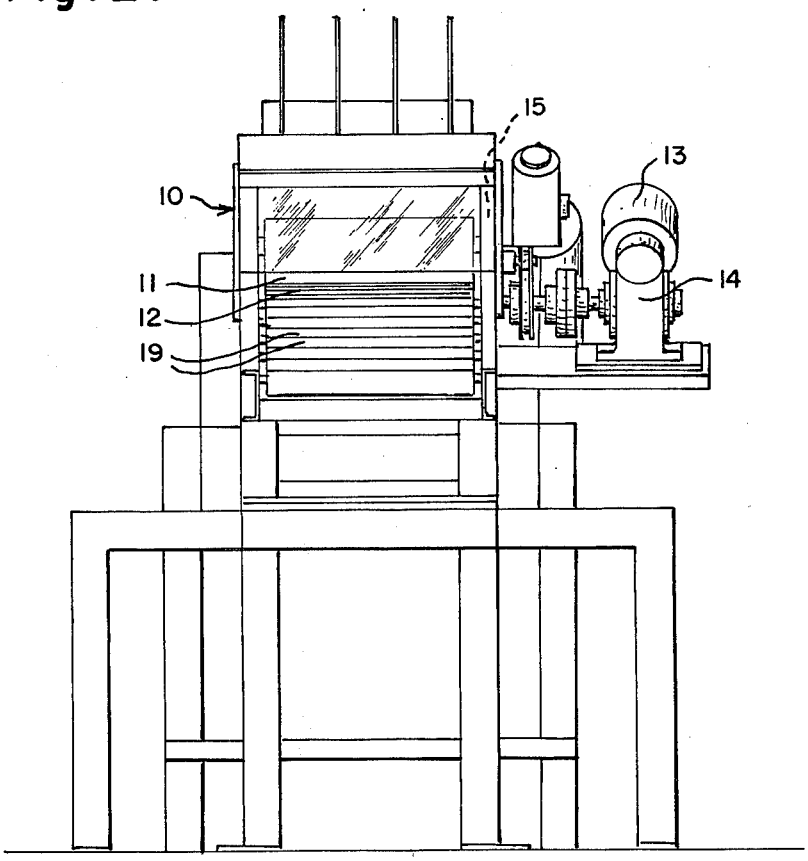

In the foregoing general description, I have set out certain objects, purposes and advantages of this invention. Other objects, purposes and advantages of this invention will be apparent from a consideration of the following description and the accompanying drawings in which:

FIG. 1 is a side elevational view, partly in section, of an apparatus according to my invention; and FIG. 2 is a front elevational view of the apparatus of FIG. 1.

Referring to the drawings, I provide a housing 10 having at least one pair of upper rubber rolls 11 and lower toothed rolls 12. The toothed rolls are made up of "Desmond", a tradename for toothed grinding wheel dresser wheels put together to form an elongate roll. The lower rolls 12 are driven by an electric motor 13 through a gear train 14, with successive rolls, where used being connected together by gears to form a continuous drive. The rubber rolls are mounted in a carrier 15 which is moved toward and away from the toothed rolls by screw jacks 16 which are moved in unison to maintain a substantially uniform pass opening between the rolls.

The operation of the apparatus will be described for the removal of glass tubing from aspiration cast rods where the metal is drawn by vacuum into glass tubes. The metal rods with the glass coating 101 are dropped from the casting apparatus into bin 100, then picked up by conveyor 20 and fed into the feed end of the housing

10 on conveyor rolls 18 between the rubber rolls 11 and toothed metal rolls 12, with the spacing between the rolls adjusted for the diameter of the metal rods. The rubber rolls 11, which are driven by motor 13 pull the glass coated rods through between the rolls while the toothed rolls "munch" or break up and remove the glass from the rod surface in small pieces which fall down from between the rolls in the housing into a collecting hopper 22 and the metal rods are discharged from the exit end of housing 10 completely free of glass and are discharged off the end of conveyor rolls 19 into a suitable collection device (not shown). It is, of course, obvious that a plurality of rods can pass through rolls side by side at the same time.

In the foregoing specification I have set out certain preferred practices and embodiments of my invention, however, it will be understood that this invention may be otherwise embodied within the scope of the following claims.

I claim:

1. An apparatus for removing glass from metal surfaces and the like such as glass coated rods comprising a pair of spaced apart rolls forming a pass line therebetween, one of said rolls being a resilient roll, the other of said rolls being a toothed hard roll having a multiplicity of relatively sharp pointed teeth closely spaced about the periphery of roll and extending from the body of the roll as an array of discrete points adapted to engage and break up the glass on the metal surfaces, means for adjusting said rolls relative to one another to vary the opening therebetween to provide a gap substantially equal to the thickness of the metal being cleaned and from which the glass is being removed and drive means rotating at least one of said rolls to move the metal article from which glass is to be removed through between the rolls.

2. An apparatus as claimed in claim 1 wherein said one roll is a rubber roll.

3. An apparatus as claimed in claim 1 wherein the toothed roll is made up of a plurality of side-by-side toothed wheels on a common shaft.

4. An apparatus as claimed in claim 1 having a housing carrying a plurality of pairs of said rolls in succession, forming an elongate pass line, said resilient rolls being driven by the drive means, said toothed rolls being mounted in a common frame movable relatively to the resilient rolls and jack means acting on said frame to move said toothed rolls selectively relatively to the resilient rolls.

5. The method of removing glass from metal surfaces comprising the steps of:

(a) providing a pair of spaced apart rolls, one of which is a toothed hard roller and the other a cooperating resilient roller forming between them a pass line whose nip is substantially equal to the thickness of the metal being cleaned, (b) driving said rolls for rotation; and (c) passing the glass coated metal between the rolls to cause the toothed roll to break up the glass on the metal surfaces.

6. The method as claimed in claim 5 wherein the metal to be cleaned is a rod encased in a glass tubing, and the rolls are spaced apart a distance substantially equal to the rod, the toothed roll being a metal roll.

7. The method as claimed in claim 6 wherein the toothed metal roll is a plurality of side-by-side toothed metal wheels on a common axis forming a roll.

* * * * *